United States Patent [19]

Peters

[11] Patent Number: 5,052,642

[45] Date of Patent: Oct. 1, 1991

[54] SWITCH STAND

[76] Inventor: Terry D. Peters, Rt. 4, Box 19, Elkhorn, Nebr. 68022

[21] Appl. No.: 510,441

[22] Filed: Apr. 18, 1990

[51] Int. Cl.[5] ..... B61L 5/06

[52] U.S. Cl. ..... 246/393; 246/218

[58] Field of Search ..... 246/218, 262, 263, 393, 246/405, 407, 410, 411, 489

[56] References Cited

U.S. PATENT DOCUMENTS

| | | | |
|---|---|---|---|
| 3,127,138 | 3/1964 | Wilson et al. | 246/393 |
| 3,136,509 | 6/1964 | Magnus | 246/393 |
| 3,363,097 | 1/1968 | Wilhelm et al. | 246/393 |
| 3,621,237 | 11/1971 | Hylen | 246/411 |
| 3,708,660 | 1/1973 | Speight | 246/393 |
| 4,022,409 | 5/1977 | Ensink et al. | 246/218 |

FOREIGN PATENT DOCUMENTS

| | | | |
|---|---|---|---|
| 2122790 | 1/1984 | United Kingdom | 246/262 |

*Primary Examiner*—Robert J. Spar
*Assistant Examiner*—Scott L. Lowe
*Attorney, Agent, or Firm*—Zarley, McKee, Thomte, Voorhees & Sease

[57] ABSTRACT

A railroad track switch stand includes a support frame having a throw crank operably mounted thereon for reciprocating a connecting rod. A pair of cams are mounted on the throw crank so as to rotate the throw crank on the frame. A throw arm is operably connected to the frame and associated with one cam so as to engage the cam and rotate the throw crank. A second throw arm is associated with the second cam so as to engage the second cam and rotate the throw crank. The throw arms are mounted on the frame so as to be out of engagement with the associated cams, until moved between first and second positions. Each throw arm has a cam-engaging roller which is slidably mounted, so as to engage the associated cam when the throw arm and cam are initially in adjacent positions, and so as to bypass engagement with the cam when the cam and throw arm are initially in opposite positions. The first and second throw arms are independently operable to allow either throw arm to throw the throw crank and thereby throw the associated railroad track switch.

1 Claim, 5 Drawing Sheets

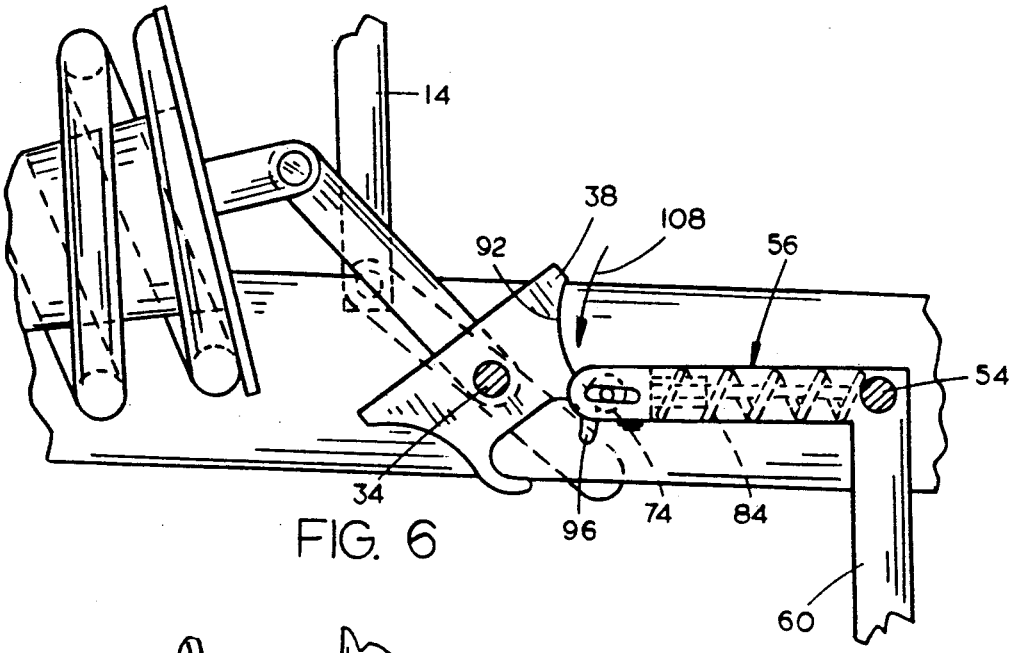
FIG. 6
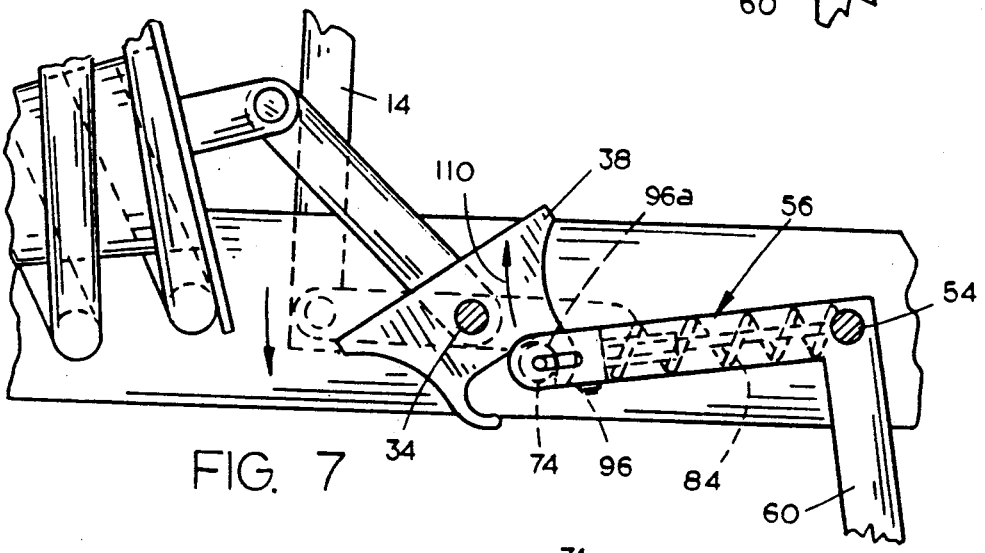
FIG. 7
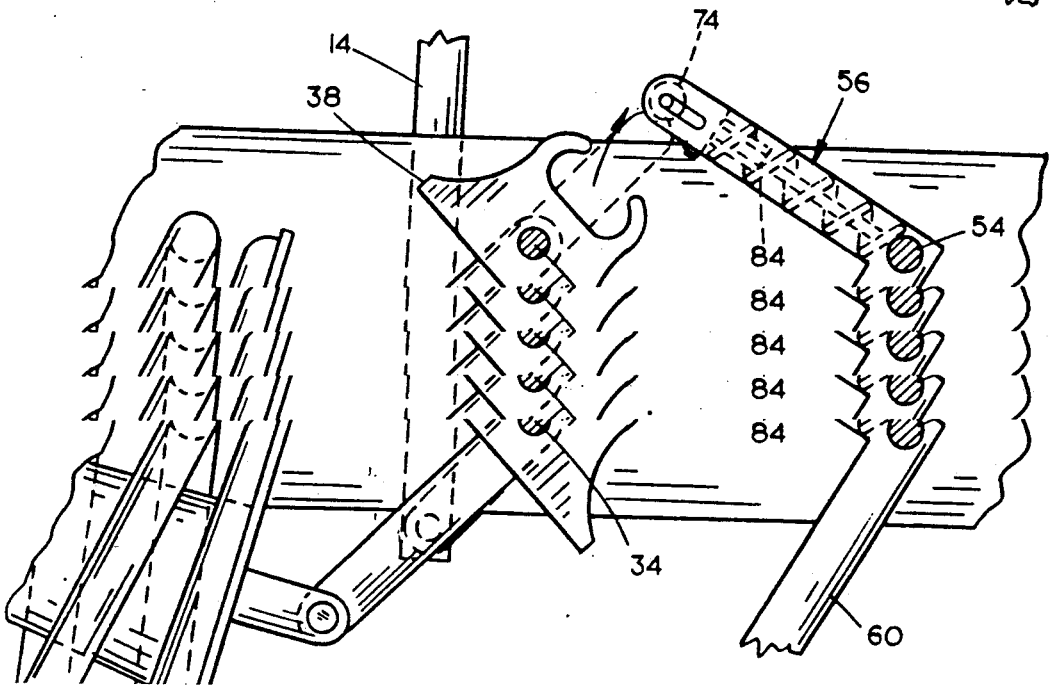

SWITCH STAND

TECHNICAL FIELD

The present invention relates generally to railway switch stands, and more particularly to a switch which may be electrically actuated.

BACKGROUND OF THE INVENTION

Railway switch stands have been utilized on railroads for many years, and are the subject of a large number of patents. However, the current switch stands in operation still suffer several drawbacks. The major problem with present day hand-operated throw type switches is in the many back and leg injuries to railroad personnel caused by the actual throwing of the switch. Such injuries can be quite expensive to the railroad in loss of personnel and damage suits brought by the injured persons.

Another problem with prior art switch stands is apparent in situations where a train runs through a switch which is in the wrong position. In such a case, the switch stand components are typically destroyed. Such switch stands are expensive to replace, and require time and labor of railroad personnel to install. Although prior art devices have utilized shear pins and the like to protect the major components of a switch stand in the event of a run-through, there must still be a maintenance crew to repair the switch stand after the run-through, as well as a certain amount of "down" time.

Various types of electric switches are known, which obviously would prevent injury to railroad personnel. However, all such electrical switches are not capable of manual operation in the event of a loss of power.

It is therefore a general object of the present invention to provide an improved electrically-actuated switch.

Another object of the present invention is to provide an electrically-actuated switch which allows a run-through without destroying the switch stand.

A further object is to provide an electrically-actuated switch which is capable of immediate re-use after a run-through.

Still another object of the present invention is to provide an electrically actuated switch which may be operated manually independently of the electrical actuator.

These and other objects of the present invention will be apparent to those skilled in the art.

SUMMARY OF THE INVENTION

The railroad track switch stand of the present invention is connected to a reciprocating connecting rod which extends to a railroad track switch so as to operate the switch between open and thrown positions. The switch stand includes a support frame having a throw crank operably mounted thereon for reciprocating the connecting rod. A large coil spring is connected to the throw crank so as to bias the throw crank into either a first position with the railroad track switch in an open position, or into a second position wherein the railroad track switch is moved to the thrown position. A pair of cams are mounted on the throw crank so as to rotate the throw crank on the frame. A throw arm is operably connected to the frame and associated with one cam so as to engage the cam and rotate the throw crank. A second throw arm is associated with the second cam so as to engage the second cam and rotate the throw crank.

The throw arms are mounted on the frame proximal to their associated cams, but out of engagement therewith. Movement of a throw arm from a first position to a second position will engage the associated cam and throw the throw crank. Each throw arm has a cam-engaging roller which is slidably mounted, so as to engage the associated cam when the throw arm and cam are in adjacent positions and the throw arm is moved from the first to second position. The cam-engaging roller is slidably mounted such that movement of the throw arm from a position opposite the position of the associated cam will bypass engagement with the cam until the throw arm has been moved to a position adjacent with the associated cam. A similar arrangement is utilized with the second cam and second throw arm. The first and second throw arms are independently operable to allow either throw arm to throw the throw crank and thereby throw the associated railroad track switch.

BRIEF DESCRIPTION OF THE DRAWINGS

FIG. 6 is an enlarged top view of the cam mechanism after a run-through;

FIG. 7 is a top view of the cam mechanism after recycling the manual throw arm; and FIG. 8 is a top view of the cam mechanism after the manual throw arm has thrown the switch.

DESCRIPTION OF THE PREFERRED EMBODIMENT

Figure 1:
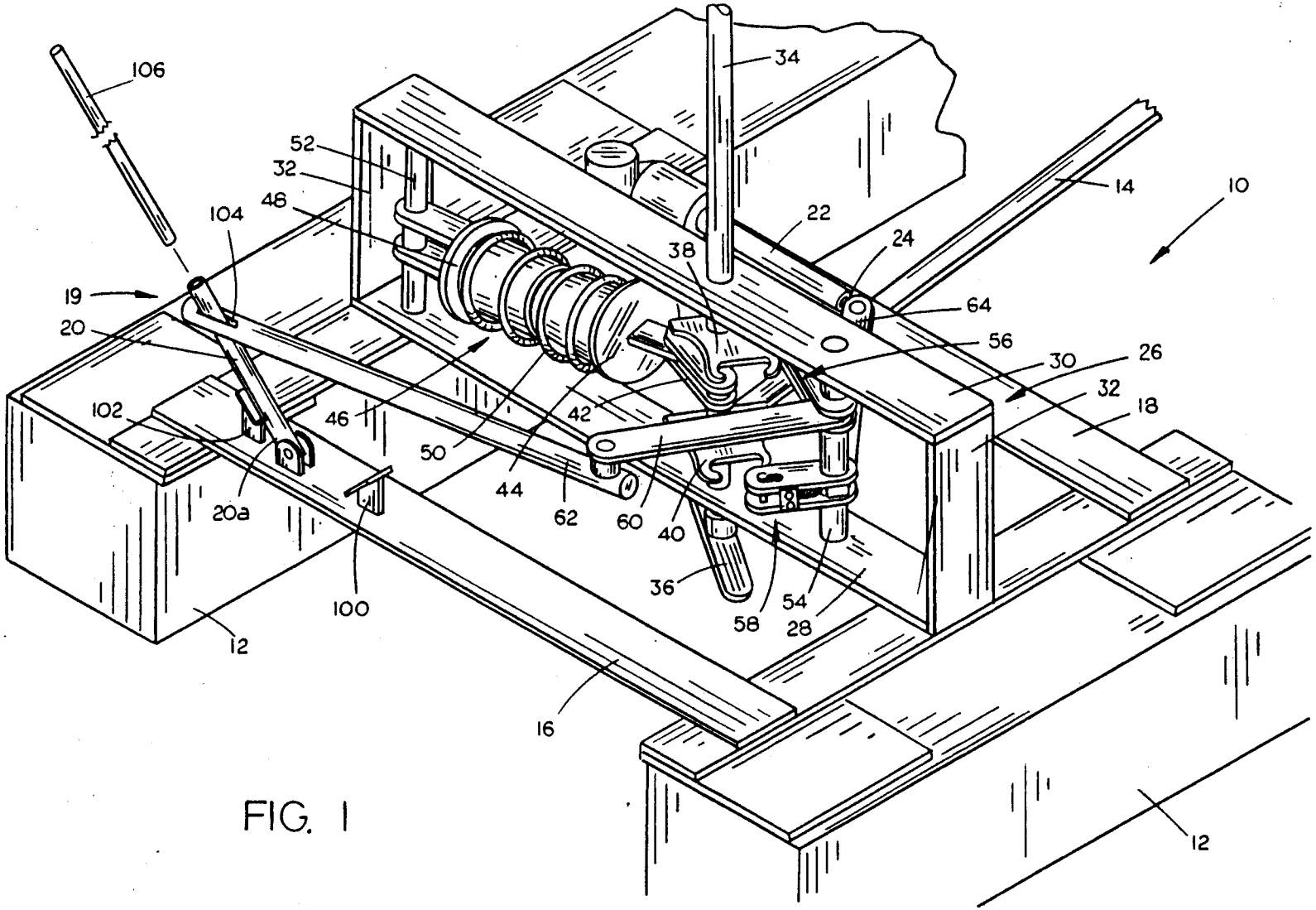
FIG. 1 is a perspective view of the electrically actuated switch mechanism of the present invention.

Referring now to the drawings, in which identical or corresponding parts are identified with the same reference numeral, and more particularly to FIG. 1, the electrically actuated switch stand of the present invention is designated generally at 10. Switch stand 10 is mounted on a pair of parallel ties 12 and is operably connected to a connecting rod 14 so as to operate the points of the switch between first and second positions.

A pair of parallel and spaced-apart base plates 16 and 18 extend between ties 12, base plate 16 supporting a pivotable tube 20 of a manual throw assembly 19 for manual operation of the switch. Base plate 18 supports an electrical throw assembly 21, including an electrically operated cylinder 22 having a push rod 24, for electrical actuation of the switch.

A central frame 26 is mounted between ties 12 parallel to base plates 16 and 18, and includes a lower support plate 28, an upper plate 30 parallel to support plate 28 and a pair of vertical members 32 connecting upper and lower plates 30 and 28.

Figure 5:
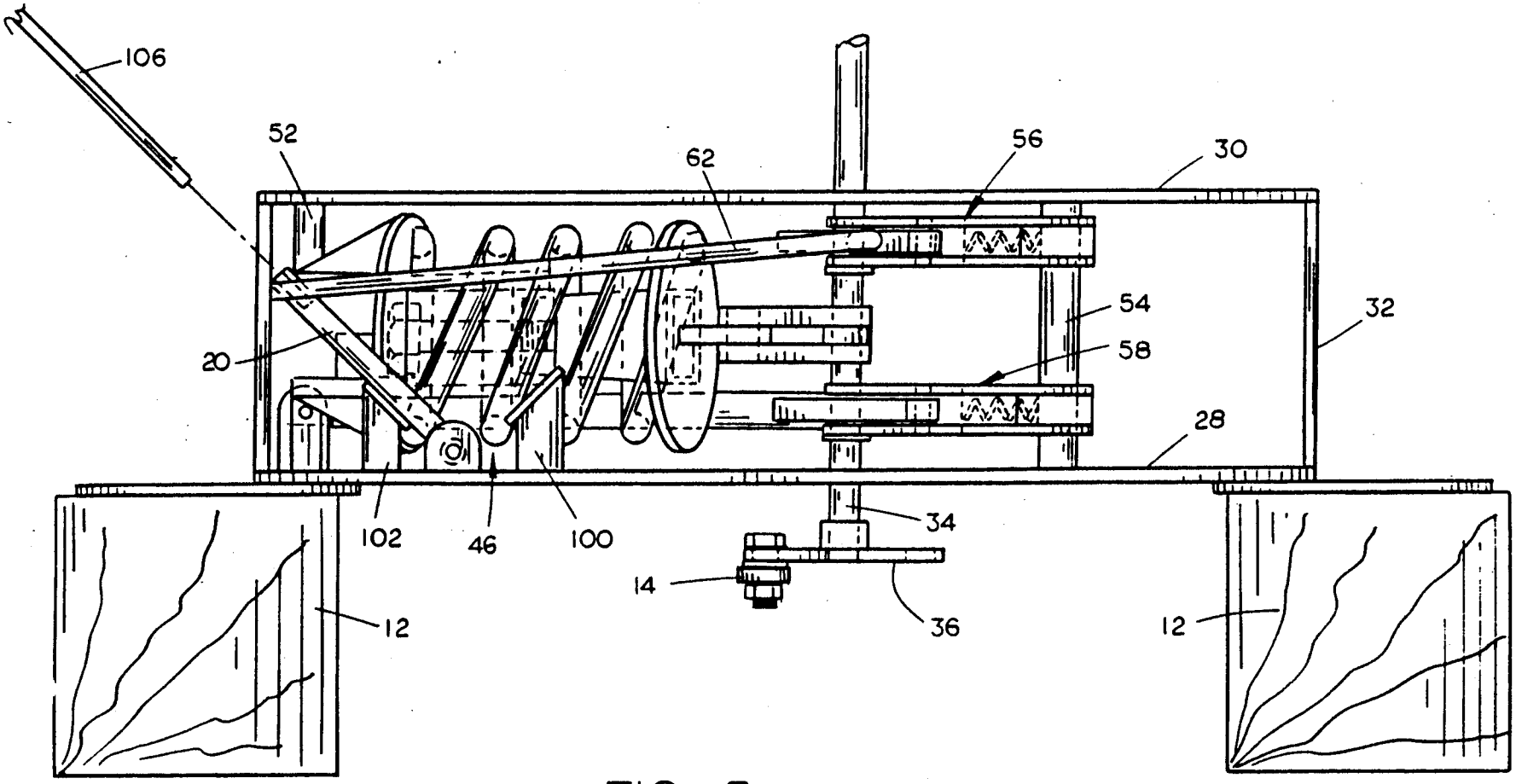
FIG. 5 is a front elevational view of the present invention.

As with conventional switch stands, a vertically oriented throw crank 34 is rotatably mounted through upper and lower plates 30 and 28 and has a horizontally projecting rod 36 affixed to its lower end for rotation therewith. One end of rod FIG. 5, such that rotation of throw crank 34 moves connecting rod 14 longitudinally to throw a switch. Throw crank 34 has an upper and lower cam 38 and 40, respectively, mounted thereon and vertically spaced apart, for rotation with throw crank 34. Manual throw assembly 19 is operably associated with upper cam 38, and electrical throw assembly 21 is operably associated with lower cam 40 to operate the switch, as will be described in more detail hereinbelow.

A short pivot arm 42 is mounted on throw crank 34 between cams 38 and 40, and is pivotally connected at its free end to a forward plate 44 of a large compression spring 46. Compression spring 46 includes a rearward plate 48 and a coil spring 50 mounted between forward and rearward plate 44 and 48. Rearward plate 48 is pivotally mounted to a vertical shaft 52 so that compression spring 46 will pivot through a horizontal plane with the rotation of throw crank 34. Thus, throw crank 34 must overcome the bias of coil spring 50 between forward and rearward plates 44 and 48 in order to rotate from the first position to the second position, and thereby move the switch points.

A bearing shaft 54 is mounted between upper and lower plates 30 and 28, parallel to throw crank 34 and spaced therefrom. An upper an lower throw arm 56 and 58, respectively, are pivotally mounted on bearing shaft 54 for independent pivotal movement. An elongated arm 60 is mounted at one end to upper throw arm 56 and pivotally connected at the other end to an extension arm 62, which extends to and is operably connected with tube 20. An elongated arm 64 has one end connected to lower throw arm 58 and the other end pivotally connected to push rod 24 of cylinder 22. Elongated arm 60 is connected to upper throw arm 56 such that movement of arm 60 about bearing shaft 54 will also move upper throw arm 56 about bearing shaft 54. Similarly, elongated arm 64 is connected to throw arm 58 to move throw arm 58 about bearing shaft 54.

Figure 2:
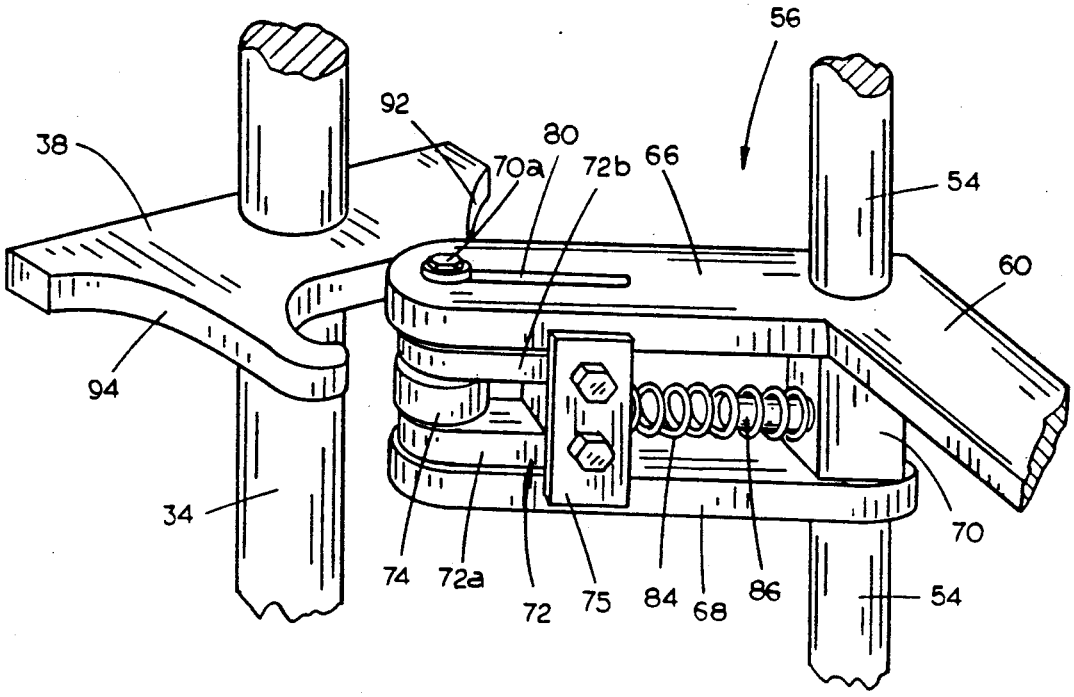
FIG. 2 is an enlarged pictorial view of one throw arm and associated cam of the present invention.

Referring now to FIG. 2, throw arm 56 is shown in enlarged perspective in order to describe the details thereof. Upper throw arm 56 is identical to lower throw arm 58, and therefore only one will be described. Throw arm 56 includes a pair of elongated spaced apart upper and lower plates 66 and 68 connected by a spacer 70 and rotatably mounted on bearing shaft 54 through the ends connected by spacer 70. Elongated arm 60 is mounted to upper plate 66 and will rotate throw arm 58 about bearing shaft 54.

A yoke 72 has a roller 74 rotatably mounted between the legs 72*a* and 72*b* thereof, yoke 72 being slidably mounted between upper and lower plates 66 and 68. A pair of vertical guide plates 75 and 76 (not shown) are bolted to yoke 72 and extend vertically beyond upper and lower plates 66 and 68, such that yoke 72 will slide only longitudinally along upper and lower plates 66 and 68. A vertically oriented axle 70*a* extends through roller 74 and through elongated slots 80 and 82 (not shown) in upper and lower plates 66 and 68 respectively. Slots 80 and 82 are oriented longitudinally on upper and lower plates 66 and 68 to assist in guiding yoke 72 and roller 74 longitudinally. A coil spring 84 extends between yoke 72 and spacer 70 so as to bias yoke 72 and roller 74 away from bearing shaft 54. A pin 86 projects from spacer 70 within coil spring 84 to prevent the spring from bending outwardly during compression. Thus, it can be seen that roller 74 and yoke 72 may be moved longitudinally towards bearing shaft 54 against the bias of coil spring 84, spring 84 then returning roller 74 to its original position.

Figure 3:
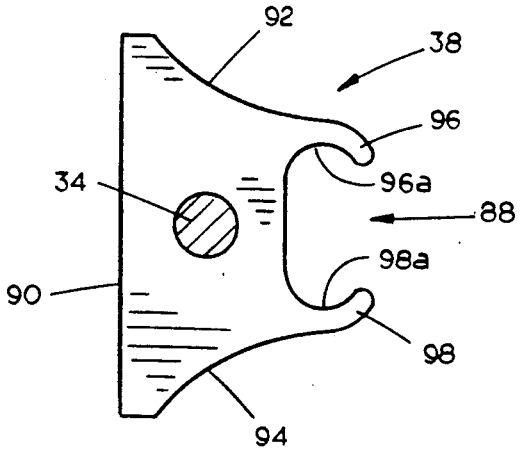
FIG. 3 is a top view of the cam of FIG. 2.

Each cam 40 and 38 are identical, and are mounted on throw crank 34 in vertically aligned spaced apart orientation. FIG. 3 is a top view of upper cam 38. All features of upper cam 38 are also found in lower cam 40, and therefore, only one cam will be described in detail.

For purposes of description, cam 38 will be described as having a forward jaw end 88, a rearward flat end 90 and right and left side edges 92 and 94 respectively. Jaw end 88 includes a pair of arcuate hook-shaped teeth 96 and 98, each tooth having an arcuate interior edge 96*a* and 98*a*, respectively, forming slightly less than a semicircle. Interior edges 96*a* and 98*a* are directed toward one another, to receive roller 74 therein, as will be described in more detail hereinbelow. Each side edge 92 and 94 of cam 38 is arcuate, so as to form a concave edge extending from adjacent rear edge 90, the side edge then becoming convex at each tooth 96 and 98. This concave-convex shape assists in operation of the associated throw arm 56, as will be described in more detail hereinbelow.

Referring once again to FIG. 1, manual throw assembly 19 is utilized to manually throw the switch connected to switch stand 10. Tube 20 is pivotally connected at its lower end 20*a* to base plate 16, so as to pivot within a vertical plane generally parallel with central frame 26. A forward and rearward stop 100 and 102 are each mounted on base plate 16 within the pivotal path of tube 20 to restrict the extent of the pivotal movement of tube 20. Tube 20 extends through an elongated slot 104 in one end of extension arms 62 so as to force extension arm 62 forwardly and rearwardly in association with the pivotal movement of tube 20. A removable extension road 106 may be journaled within tube 20 to give the user leverage in manually throwing the switch.

Figure 4:
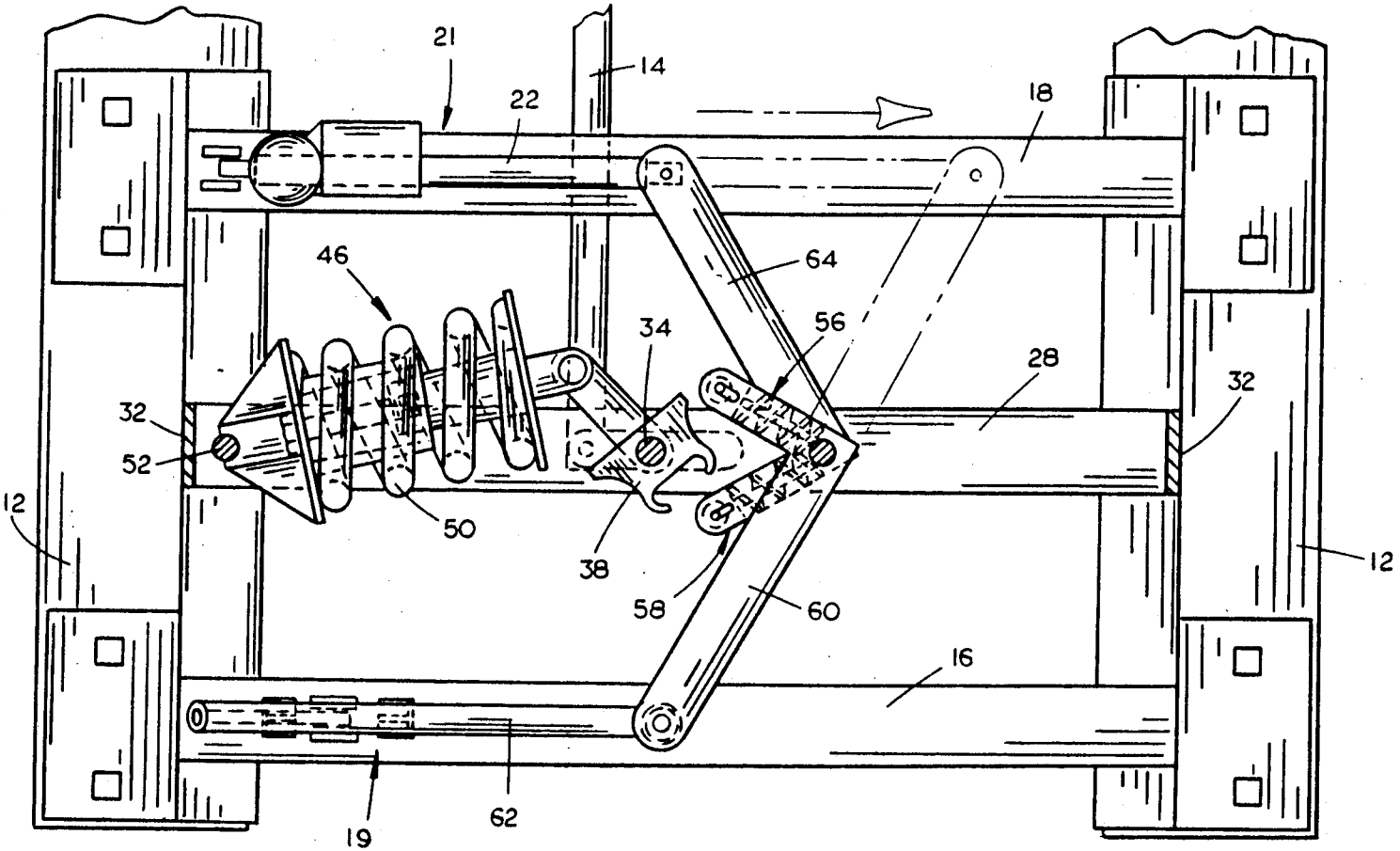
FIG. 4 is a top view of the mechanism shown in FIG. 1.

As shown in FIG. 4, manual throw assembly 19 is operable independent of electrical throw assembly 21. In this particular figure, electric throw assembly 21 has been operated so as to rotate throw crank 34 and move connecting rod 14 to throw the switch. Manual throw assembly 19 remains in its original position. The broken line position of elongated arm 64 shows the movement of electrical throw assembly 21 so as to operate the switch and return it to its original position.

FIGS. 6–8 show the sequence utilized to operate the switch when the throw arm is in a position reversed from the associated cam, such as when a train runs through a switch so as to throw the cam in the opposite direction. In this instance, the elements of manual throw arm assembly 19, as shown in FIG. 4, are shown in detail, with the elements of electrical throw assembly 21 eliminated, for purposes of clarity. As shown in FIG. 4, upper cam 38 will rotate without affecting the position of throw arm 56 of manual throw assembly 19. In order to return the switch to its original position before the run-through, extension rod 106 is inserted within tube 20, and tube 20 is pivoted from the rearward position shown in FIG. 1 to its forward position.

As tube 20 is pivoted forwardly, extension arm 62 is also moved forwardly so as to pivot elongated arm 60 about bearing shaft 54. As shown in FIG. 6, movement of elongated arm 60 will also pivot throw arm 56 in the direction shown by arrow 108. As throw arm 56 is pivoted, roller 74 will contact convex side edge 92 of cam 38 and will be forced rearwardly against the bias of coil spring 84. Once throw arm 56 pivots past tooth 96 of cam 38, roller 74 will be biased outwardly to its original position by coil spring 84. Thus, movement of manual throw arm assembly from its rearward position shown in FIG. 1, to its forward position, will re-orient throw arm 56 into a location which will now throw cam 38, throw crank 34, connecting rod 14 and the associated switch.

To throw the switch, manual throw assembly 19 is moved from its forward position rearwardly to the position shown in FIG. 1. This will pivot elongated arm 60 and throw arm 56 towards cam 38. Since coil spring 84 has returned roller 74 to its original outward position, roller 74 will be received against the inside edge 96*a* of tooth 96, as shown in FIG. 7. Continued movement of throw arm 56 as indicated by arrow 110 will cause roller 74 to push on tooth 96 and rotate cam 38, until cam 38 reaches its second position, as shown in FIG. 8.

Since manual throw assembly 19 and electrical throw assembly 21 are operably independent, either one may be utilized to throw the switch without affecting the other. If a train runs through the switch so as to move the cams to a position opposite that of electrical and manual throw assembles 21 and 19, either throw assembly 21 or 19 may be "recycled" to operate the switch and return it to its original position, as was described above with respect to FIGS. 6, 7 and 8.

Whereas the invention has been shown and described in connection with the preferred embodiments thereof, it will be understood that many modifications, substitutions and additions may be made which are within the intended broad scope of the appended claims. Thus, there has been shown and described an improved electrically actuated switch which accomplishes at least all of the above-stated objects.

I claim:

1. A railroad track switch stand having a reciprocating connecting rod extending therefrom for operating a railroad track switch between open and thrown positions, comprising:

a support frame;

a throw crank operably mounted to said frame and connected to said connecting rod to selectively reciprocate the connecting rod;

said throw crank including a vertically oriented shaft rotatably mounted on said frame and rotatable between a first position to move said switch to the open position, and a second position to move said switch to the thrown position;

operable biasing means connected to said throw crank for biasing said throw crank into said first position and said second position;

first cam means affixed to said throw crank shaft so as to rotate said shaft when said first cam means is engaged by a first throw arm, said first cam being rotatable with said throw crank between first and second positions;

said first throw arm operably connected to said frame and operable between first and second positions;

said cam first position being adjacent said throw arm first position and opposite said throw arm second position, and said cam second position being adjacent said throw arm second position and opposite said throw arm first position;

said first throw arm including means for engaging said cam when the cam and throw arm are in adjacent positions and the throw arm is moved to the opposite position, and for bypassing engagement with said cam when the cam and throw arm are in opposite positions and the throw arm is moved to the position adjacent the cam position;

means for operating said first throw arm between said first and second positions;

a second cam means affixed to said throw crank shaft so as to rotate said shaft when engaged by a second throw arm, said second cam being rotatable with said throw crank between first and second positions;

said second throw arm operably connected to said frame and operable between first and second positions;

said second cam first position being adjacent said second throw arm first position and opposite said second throw arm second position, and said second cam second position being adjacent said second throw arm second position and opposite said second throw arm first position;

said second throw arm including means for engaging said second cam when said second cam and second throw arm are in adjacent positions and the second throw arm is moved to the opposite position, and for bypassing engagement with said second cam when said second cam and second throw arm are in opposite positions and the second throw arm is moved to the position adjacent said second cam;

means for operating said second throw arm between said first and second positions;

said means for operating said first throw arm including an electrical cylinder; and said means for operating said second throw arm including a manually operated mechanical lever.

* * * * *